US007300311B2

(12) United States Patent
Park

(10) Patent No.: US 7,300,311 B2
(45) Date of Patent: Nov. 27, 2007

(54) PIN HOLDER STRUCTURE OF INPUT/OUTPUT PLUG

(76) Inventor: Young-Tae Park, 2244-1603, Jindalae Maeul, 527-1, Sang-dong, Wonmi-gu, Bucheon-city, Kyungki-do (KR) 420-030

( * ) Notice: Subject to any disclaimer, the term of this patent is extended or adjusted under 35 U.S.C. 154(b) by 0 days.

(21) Appl. No.: 11/335,720

(22) Filed: Jan. 19, 2006

(65) Prior Publication Data

US 2007/0167042 A1 Jul. 19, 2007

(51) Int. Cl.
*H01R 13/648* (2006.01)

(52) U.S. Cl. ..... 439/607

(58) Field of Classification Search ..... 439/607, 439/610, 946

See application file for complete search history.

(56) References Cited

U.S. PATENT DOCUMENTS 6,050,854 A * 4/2000 Fang et al. ..... 439/607

6,913,489 B2 * 7/2005 Chai et al. ..... 439/607

* cited by examiner

*Primary Examiner*—Javaid H. Nasri
(74) *Attorney, Agent, or Firm*—Synnestvedt Lechner & Woodbridge LLP

(57) ABSTRACT

The present invention relates to a pin holder structure of an input/output plug for a vehicle phone or Personal Digital Assistant(PDA), and more particularly to an improvement of combination between a pin holder of an input/output plug and a cover plate. The present invention has advantages that because a pin holder is at its upper and lower portions combined with the cover plate which has the corresponding size and shape, it can be prevented from the damage and abrasion due to an outside impact and the cover plate and the circuit board thereon can be prevented from the distortion due to an outside impact and a bad contact between the pin and the circuit board can be prevented because the lower plate of the cover plate is projectedly formed at its bottom portion with a convex portion to have a certain tension.

5 Claims, 2 Drawing Sheets

PIN HOLDER STRUCTURE OF INPUT/OUTPUT PLUG

BACKGROUND OF THE INVENTION

1. Field of Invention

The present invention relates to a pin holder structure of an input/output plug for a vehicle phone or Personal Digital Assistant(PDA), and more particularly to an improvement of combination between a pin holder of an input/output plug and a cover plate.

2. Description of the Prior Art

In general, a pin holder of an input/output plug for a vehicle phone is manufactured to have 24 pin connectors with materials such as a plastic having light and low cost characteristics.

However, the conventional pin holder of the input/output plug has problems that an outside surface of the pin holder rubs, the great number of times, with the input/output terminal of the vehicle phone or PDA. Therefore, it may be damaged or abrased while using for a long times because the one side end of the pin holder is projectedly formed for being combined/detached to/from the input/output terminal of the phone.

Furthermore, because the pin holder of the input/output plug must be connected to the Printed Circuit Board(PCB) having a cable, the PCB may be damaged due to an outside impact to the pin holder or a communication error may occur due to an untreated shield or a bad contact of the soldering portion.

SUMMARY OF THE INVENTION

Therefore, the present invention is invented to resolve the above problems of the conventional pin holder and it is an object of the present invention to provide a pin holder structure of an input/output plug which is capable of preventing a bad contact due to untreated shield of a connector and preventing the damage and abrasion of the pin holder due to an outside impact.

In order to achieve the above object the present invention provides a pin holder structure of an input/output plug comprising a pin holder structure of an input/output plug comprising a pin holder including a pin combination portion projectedly formed having at its inside with a contact pin for inserting input/output terminals of an outer device and combination projections projectedly formed at the rear upper and lower portions; and a cover plate including a through hole formed at the front portion for keeping the pin combination portion to be opened and upper and lower plates formed at their surfaces with projection inserting grooves for being inserted the combination projections of the pin holder thereto.

The lower plate of the present invention is formed to be prolonged toward its longitudinal direction and formed at its rear portion with a shield extruding groove for extruding a shield wire for grounding and formed at its bottom portion with a convex portion to be prolonged toward its longitudinal direction for preventing a distortion due to an outside impact.

DETAILED DESCRIPTION OF THE PREFERRED EMBODIMENT

The detailed description of the present invention will now be described with reference to the drawings.

Figure 1:
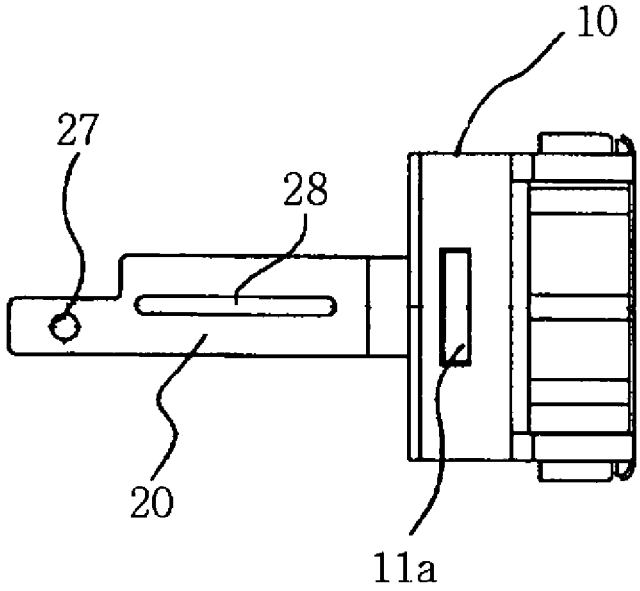
FIG. 1 is a plan view of a pin holder mounted a cover plate according to the present invention.
Figure 2:
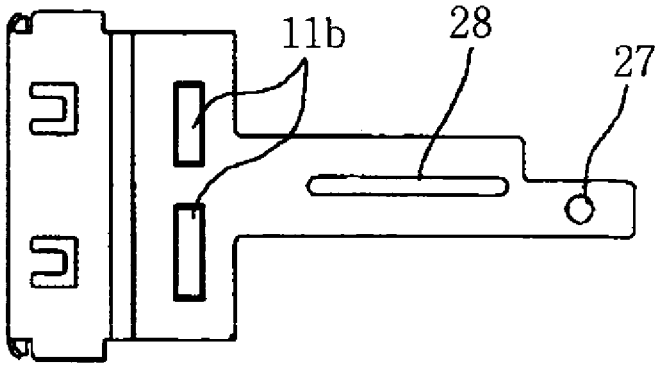
FIG. 2 a bottom view of a pin holder mounted a cover plate according to the present invention.
Figure 3:
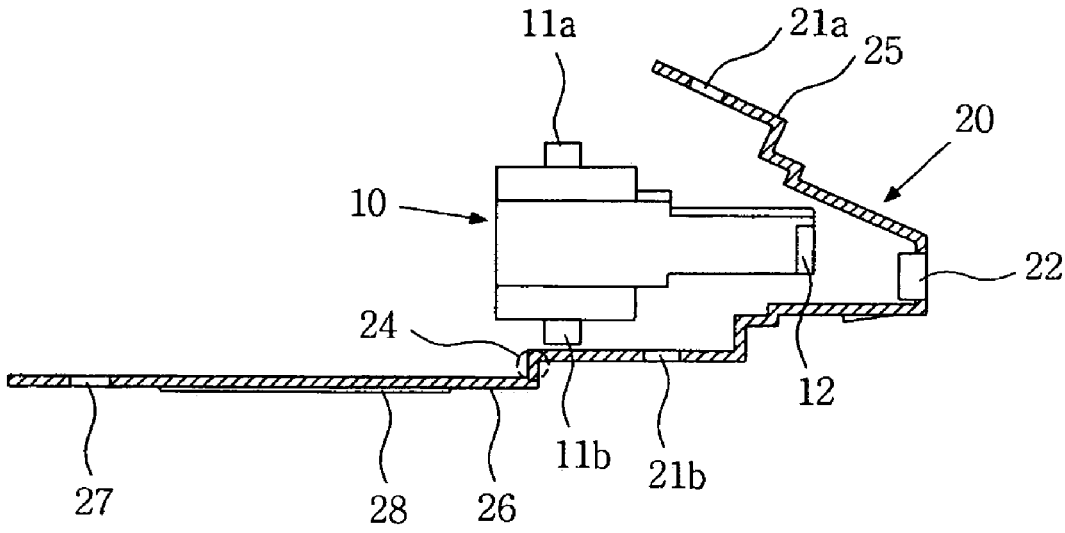
FIG. 3 is a side sectional view of the combination structure of a cover plate and a pin holder.

FIG. 1 is a plan view of a pin holder mounted a cover plate according to the present invention, FIG. 2 is a bottom view of a pin holder mounted a cover plate according to the present invention and FIG. 3 is a side sectional view of the combination structure of a cover plate and a pin holder.

As shown in FIGS. 1 to 3, the present invention comprises a pin holder 10 of an input/output plug being connected to an input/output terminals of a vehicle phone for transmitting/receiving data to/from the vehicle phone, and a cover plate 20 closely mounted at the upper and lower portions of the pin holder 10 for preventing damage and abrasion thereof due to an outside impact and being not occurred a communication error by preventing a bad contact between a contact pin not shown of the pin holder 10 and a circuit board not shown due to an untreated shield not shown.

The pin holder 10 has at its inside with a circuit board and wiring not shown and is projectedly formed at its one side with a pin combination portion 12 having a contact pin for transmitting/receiving the data to/from the vehicle phone or PDA by being connected to the input/output terminal of the vehicle phone or PDA. The pin holder 10 is projectedly formed at its rear upper and lower portions with a plurality of projections 11*a* and 11*b* for being inserted to the projection inserting groove of the cover plate 20. In drawings, one projection 11*a* is formed at the rear upper portion and two projections 11*b* are formed at the rear lower portion. The number of the projections 11*a* and 11*b* can be appropriately designed according to the size and the shape of the pin holder 10.

The cover plate 20 includes an upper plate 25 and a lower plate 26, which has its front portion with the corresponding shape to the pin holder 10 for the close combination of the pin holder 10 to the inside upper and lower portions thereof. The cover plate 20 is formed at its front side with a through hole 22 for combining the pin combination portion 12 of the pin holder 10 and the input/output terminal of the vehicle phone or PDA. The upper plate 25 and the lower plate 26 of the cover plate 20 are formed at the predetermined portion with the projection inserting groove 21 for being inserted the combination projections 11*a* and 11*b* of the pin holder 10 so that the pin holder 10 can be strongly combined thereto.

The lower plate 26 of the cover plate 20 is formed to be prolonged toward the longitudinal direction thereof for mounting a circuit board thereon and is formed at its rear portion with a recession portion 24 for preventing the interference of the circuit board and is formed at its one side with a shield extruding groove 27 for extruding the shield wire not shown for grounding. The lower portion 26 is projectedly formed at its bottom portion with a convex portion 28 for preventing the distortion of the cover plate 20 due to an outside impact by having an appropriate tension. The convex portion 28 is formed to be prolonged toward the longitudinal direction.

The cover plate 20 is preferably made of elastic materials so that the upper plate 25 can be widen from the lower plate 26 on the base of the through hole 22 when the upper plate 25 is slightly pulled by hand.

Figure 4:
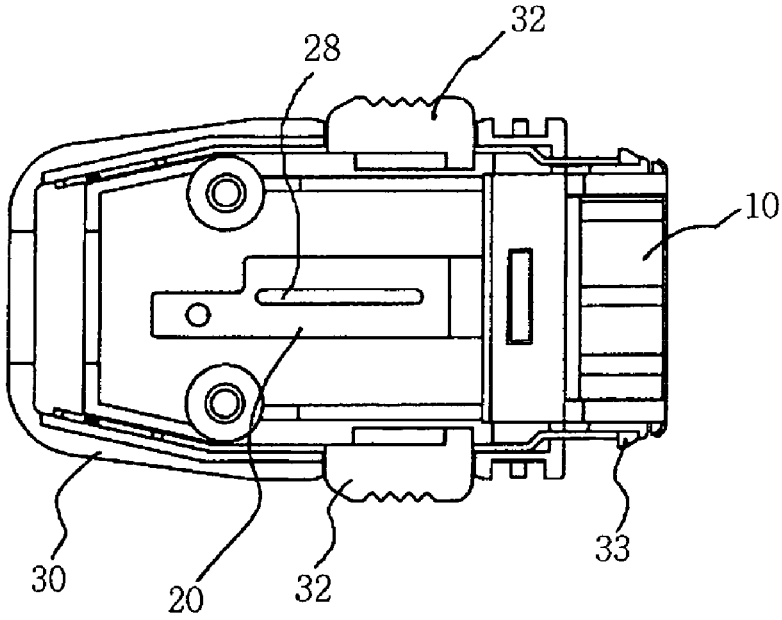
FIG. 4 is an inside structure view of a plug according to the present invention.

Meanwhile, the combination of the pin holder 10 and the cover plate 20, as shown in FIG. 4 is disposed within an outside cover 30 mounted with a guide lock 33 for easily attaching/detaching to/from the phone by manipulating a button 32 disposed at the both sides of the input/output plug.

The combination method of the pin holder and the cover plate having the above construction will now be described.

The pin holder 10 is located inside the cover plate 20 so that the pin combination portion 12 is directed toward the through hole 22. The upper plate 25 of the cover plate 20 is slightly pulled by hand to the upper direction thereby to be widen between the upper plate 25 and the lower plate 26. The lower combination projection 11*b* of the pin holder 10 is inserted to the projection inserting groove 21*b* of the lower plate 26. Therefore, the pin combination portion 12 of the pin holder 10 is located at the through hole 22 of the cover plate 20.

When the upper plate 25 is set free from the hand, it is returned to the original state by an elastic force and the upper combination projection 11*a* of the pin holder 10 is inserted to the projection groove 21*a* of the upper plate 25. Therefore, the pin holder 10 and the cover plate 20 are strongly combined.

After that, the circuit board is mounted on the lower plate 26 of the cover plate 20. The circuit board can be prevented a damage and a distortion due to an outside impact by the tension of the convex portion 28 formed at the bottom portion of the lower plate 26.

The pin combination portion 12 of the pin holder 10 is kept to be located toward the through hole 22 formed at the front portion of the cover plate 20. Therefore, the pin combination portion 12 can freely insert the input/output terminal of the PDA or the phone.

After the combination of the pin holder 10 and the cover plate 20 is located inside the outside cover 30 mounted with the buttons 32 and the guide locks 33, the shield wire is extruded through the shield extruding groove 27 of the lower plate 26 for grounding.

As the foregoing descriptions a pin holder structure of an input/output plug for a vehicle phone of the present invention has advantages as the followings.

First, because a pin holder is at its upper and lower portions combined with the cover plate which has the corresponding size and shape, it can be prevented from the damage and abrasion due to an outside impact.

Second, the cover plate and the circuit board thereon can be prevented from the distortion due to an outside impact and a bad contact between the pin and the circuit board can be prevented because the lower plate of the cover plate is projectedly formed at its bottom portion with a convex portion to have a certain tension.

What is claimed is:

1. A cover plate adapted to cover an input/output plug having at least one contact pin, a top, and a bottom, the cover plate comprising:

(a) a front portion having at least one opening such that the at least one contact pin is not covered, (b) a top portion connected to the front portion and adapted to cover the top of the input/output plug, and (c) a bottom portion connected to the front portion and adapted to cover the bottom portion of the input/output plug, said bottom portion including a shield-extruding groove for extruding a shield wire for grounding.

2. The cover plate of claim 1 wherein the top portion has a first groove adapted to accept a first projection on the input/output plug.

3. The cover plate of claim 2 wherein the bottom portion has a second groove adapted to accept a second projection on the input/output plug.

4. The cover plate of claim 1 wherein the bottom portion further comprises a prolonged convex portion.

5. The cover plate of claim 1 wherein the cover plate is made of elastic material.

* * * * *